US008798938B2

(12) United States Patent
Walter et al.

(10) Patent No.: US 8,798,938 B2
(45) Date of Patent: Aug. 5, 2014

(54) METHOD FOR DETERMINING A GAS CONCENTRATION IN A MEASURING GAS BY MEANS OF A GAS SENSOR

(75) Inventors: Michael Walter, Kornwestheim (DE); Joachim Palmer, Korntal-Muenchingen (DE); Thiebaut Beyrath, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/293,023

(22) PCT Filed: Feb. 12, 2007

(86) PCT No.: PCT/EP2007/051309

§ 371 (c)(1),
(2), (4) Date: Nov. 10, 2008

(87) PCT Pub. No.: WO2007/104621

PCT Pub. Date: Sep. 20, 2007

(65) Prior Publication Data

US 2009/0064758 A1 Mar. 12, 2009

(30) Foreign Application Priority Data

Mar. 15, 2006 (DE) ..... 10 2006 011 837

(51) Int. Cl.
*G01N 31/00* (2006.01)

(52) U.S. Cl.
USPC ..... 702/24; 702/30; 702/31; 702/32; 702/104

(58) Field of Classification Search
USPC ..... 702/22–24, 30–32, 104; 701/101, 109; 436/127, 137; 422/98; 324/465; 123/672, 691, 692, 703
See application file for complete search history.

(56) References Cited

U.S. PATENT DOCUMENTS

| | | | | |
|---|---|---|---|---|
| 4,195,531 | A * | 4/1980 | Okamura | 73/723 |
| 4,237,830 | A * | 12/1980 | Stivender | 123/493 |
| 4,809,175 | A | 2/1989 | Hosaka et al. | |
| 5,323,635 | A | 6/1994 | Ueno et al. | |
| 5,369,989 | A * | 12/1994 | Gates et al. | 73/114.06 |
| 6,227,033 | B1 * | 5/2001 | Kainz | 73/23.32 |
| 2004/0060550 | A1 * | 4/2004 | Wu et al. | 123/694 |

FOREIGN PATENT DOCUMENTS

| | | |
|---|---|---|
| DE | 25 59 046 | 7/1977 |
| DE | 37 43 315 | 6/1989 |
| DE | 10227177 | 1/2003 |
| DE | 101 47 390 | 4/2003 |
| JP | 63-41252 | 2/1988 |
| JP | 6174678 | 6/1994 |
| JP | 10-212999 | 8/1998 |
| JP | 2006-174678 | 6/2006 |
| WO | WO03/027462 | 4/2003 |

* cited by examiner

*Primary Examiner* — Elias Desta
(74) *Attorney, Agent, or Firm* — Kenyon & Kenyon LLP

(57) ABSTRACT

The invention relates to a method for determining a gas concentration in a measuring gas by means of a gas sensor. In a first mode of operation of an internal combustion engine, in which the gas concentration in the measuring gas is known, a gas concentration signal and a pressure signal are detected. A compensation parameter of the gas sensor is determined from said signals. The thus determined compensation parameter is taken into account in at least one of the two modes of operation of the internal combustion engine for determining the gas concentration.

5 Claims, 3 Drawing Sheets

METHOD FOR DETERMINING A GAS CONCENTRATION IN A MEASURING GAS BY MEANS OF A GAS SENSOR

TECHNICAL FIELD

The invention is based on a procedure for determining a gas concentration in a measuring gas with a gas sensor according to the category of the independent claim. Furthermore, the invention concerns a device for operating such a gas sensor.

BACKGROUND

A lambda regulation in connection with a catalyzer is nowadays the most efficient exhaust gas purifying procedure for the Otto engine. Very low exhaust gas values can only be achieved in interaction with currently available ignition and injection systems. The nowadays-used catalyzers have the features to reduce hydrocarbons, carbon monoxide and nitrous gases up to more than 98% if the engine is operated in a range of 1% around the stoichiometric air-fuel relation with lambda=1. The lambda value indicates how much the actually present air-fuel mixture deviates from the mass relation of 14.7 kg air and 1 kg fuel that is theoretically required for a complete combustion. Lambda is hereby the quotient of the added air mass and the theoretical air demand.

The lambda probe is also used for diesel engines, for example in order to avoid emission scatter, which can occur for example due to component tolerances.

A lambda probe or wide-band lambda probe is preferably used as the sensor element for determining the concentration of the remaining oxygen in the exhaust gas. The Nernst cell of a lambda probe provides a voltage jump at an oxygen concentration that corresponds with the lambda value=1 and delivers thereby a signal, which shows whether the mixture is richer or leaner than lambda=1. The efficiency of the lambda probe is based on the principle of a galvanic oxygen concentration cell with a solid body electrolyte.

Being constructed as two-point probes the lambda probes work in an acquainted manner according to the Nernst principle based on a Nernst cell. The solid electrolyte consists of two boundaries that are separated by a ceramic. The used ceramic material becomes conductive at about 350° C., so that at different oxygen percentages on both sides of the ceramic, the so-called Nernst voltage is produced between the boundaries. This voltage is a measure for the relation of the oxygen partial pressures on both sides of the ceramic. Since the remaining oxygen content in the exhaust gas of a combustion engine strongly depends on the air-fuel relation of the mixture that is added to the engine, it is possible to use the oxygen content in the exhaust gas as a measure for the actually present air-fuel relation.

In order to monitor the ideal air-fuel mixture composition, wide-band lambda probes are preferably used in the exhaust gas system. These probes are typically operated at temperatures between T=750° C. and T=800° C.

If a rich mixture is present, the oxygen concentration in the exhaust gas lies below an oxygen concentration that is typical for a stoichiometrically running combustion, the lambda value is therefore <1 and produces a voltage >450 mV in the Nernst cell. If a lean mixture is present, the Nernst voltage falls below 450 mV. The lambda probe however only delivers reliable values if the probe, and especially the ceramic body of the probe, provide an operating temperature of approximately >400 C.

The described cascade voltage characteristic of the two-point probe only allows a regulation in a narrow value range around lambda=1. A significant extension of this measuring area is allowed by wide-band lambda probes, at which, in addition to the Nernst cell, a second electro chemical cell, known as a pump cell, is integrated. At the wide-band lambda probe, the exhaust gas diffuses into the pump cell, whereby oxygen is added to or withdrawn from the pump cell over a pump current until the pump cell provides an oxygen concentration that corresponds with a lambda=1. The required pump current is proportional to the oxygen partial pressure, which is actually present in the exhaust gas.

A procedure for operating a wide-band lambda probe is already known from DE 101 47 390 A1, at which the oxygen content of an exhaust gas is determined with the aid of a Nernst voltage with a reference voltage, whereby a pump cell is impinged with a pump current in the case of deviations from a lambda value=1. The pump current is a measure for the value of lambda in the exhaust gas. When activating a cold probe it is provided that the Nernst voltage is kept close to the reference voltage with the aid of a pre-controlling until the Nernst voltage becomes an actual measure for the oxygen concentration in the cavity of the pump cell.

Further, it is known that the determination of a gas concentration in a measuring gas is influenced by the pressure of the measuring gas. The functioning of the gas probe requires that an inflow of the measuring gas is specifically set in a measuring room over a diffusion barrier. The inflow of the measuring gas is basically subject to the Knudsen diffusion. This means that the mean free path of the gas molecules is basically determined by the geometry of the diffusion barrier, typically the dimensions of the opening of the measuring cell. The inflow of the measuring gas is also influenced by the gas phase diffusion.

The mentioned diffusions are influenced by pressure changes of the measuring gas so that the pressure has to be considered for a precise concentration determination in the measuring gas. The pressure dependency of the concentration determination can be shown, for example, over a sensor specific compensation parameter, known as a k-value, as follows:

$$\frac{\mathrm{O2_raw(p_exh)}}{\mathrm{O2_raw(p_0)}} = \frac{\mathrm{p_exh}}{k + \mathrm{p_exh}} \cdot \frac{k + \mathrm{p_0}}{\mathrm{p_0}} \qquad \text{formula 1}$$

p__0 reference gas pressure p_exh exhaust gas pressure $O_2$_raw(p__0) gas concentration raw signal at reference gas pressure $O_2$_raw(p_exh) gas concentration raw signal at exhaust gas pressure k compensation parameter The compensation parameter depends on the specific characteristics of a sensor and varies solely because of manufacturing scatterings. Furthermore the compensation parameter gradually changes also due to ageing effects.

For correcting the concentration measurement, the determined compensation parameter is deposited in an analysis set-up at the manufacturing or application of the gas sensor and considered at the determination of the gas concentration.

SUMMARY

A procedure for determining a gas concentration in a measuring gas with a gas sensor is suggested according to the invention, at which a gas concentration signal and a pressure signal are acquired in the presence of a first operating mode of a combustion engine at which the gas concentration in the measuring gas is known. In some embodiments, the term "signal" may also be referred to herein as "parameter value." Based on these signals, a compensation parameter (k) of the gas sensor is determined. The thus determined compensation parameter (k) is then considered at least in a second operating mode of the combustion engine for the determination of the gas concentration.

Such a procedure has the advantage that manufacturing scatterings of the gas sensor can be balanced by an actual determination of the compensation parameter. Therefore, a precise oxygen signal can advantageously be determined, for example at a lambda probe, over a wide value range of the exhaust gas, especially for vehicles with Diesel particle filters.

A further advantage is that the oxygen signal is balanced over the lifetime of the probe despite age drifts of the compensation parameter.

Furthermore, it is an advantage to determine the compensation parameter (k) in at least one overrun condition of the combustion engine, since the oxygen concentration in the measuring/exhaust gas is known in this operating mode. Additionally, acquiring the measurement in several overrun conditions has the advantage that a variety of measuring values can be acquired and therefore the accuracy of the measurement is increased.

A further embodiment of the invention provides that the gas concentration signal is acquired in the at least overrun condition operating mode with the corresponding pressure signal at different moments. This method has the advantage that a variety of measuring values can be acquired already in a single overrun condition operation mode and if necessary enough values are already available from one overrun condition operation phase in order to determine the compensation parameter with sufficient accuracy.

It is provided in a further embodiment that, based on the determined gas concentration signals ($O_2$_raw) and pressure signals (p_exh), a pressure-depending function of the gas concentration ($O_2$_raw(p_exh), $O_2$_raw(p_0)) is determined, and based on this function the compensation parameter (k) is determined. This has the advantage that the non-linear performance of the gas concentration function is considered at the determination of the compensation parameter and therefore the accuracy of the gas concentration determination is increased in an advantageous way.

BRIEF DESCRIPTION OF THE DRAWINGS

Embodiments of the invention are shown in the drawings and described in the following.

DETAILED DESCRIPTION

Figure 1:
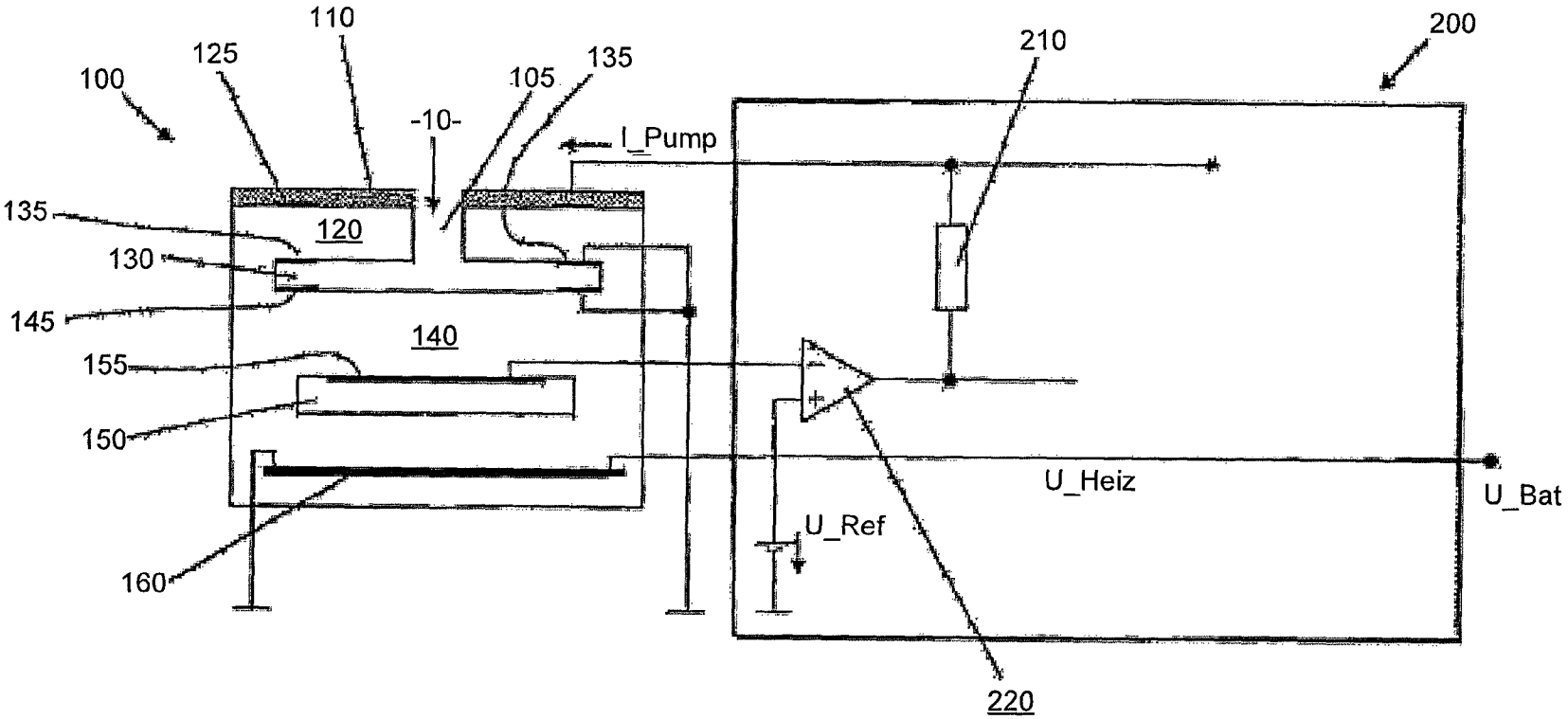
FIG. 1 PRIOR ART
FIG. 1 shows schematically the structure of a gas sensor.

FIG. 1 shows by way of example a gas sensor 100 for determining the concentration of gas components in a gas mixture with a corresponding control unit 200. The gas sensor 100 is arranged as a wide-band lambda probe in the present example. It comprises basically a heater 160 in a lower area, a Nernst cell 140 in the middle area and a pump cell 120 in the upper area. The pump cell 120 provides an opening 105 in a centered area, through which exhaust gas 10 gets into a measuring room 130 of the pump cell 120. Two electrodes 135, 145 are arranged at the outer endings of the measuring room 130, whereby the upper electrodes 135 are assigned to the pump cell 120 establishing the inner pump electrodes (IPE) 135, and the lower electrodes 145 are assigned to the Nernst cell 140 establishing the Nernst electrodes (NE). The side of the pump cell 120 that is turned towards the exhaust gas provides a protection layer 110, within which an outer pump electrode (APE) 125 is arranged. A solid electrolyte, over which oxygen can be transported into or out of the measuring room 130 at a pump voltage that is applied at the electrodes 125, 135, spans between the outer pump electrode 125 and the inner pump electrode 135 of the measuring room 130.

A further solid electrolyte, which builds the Nernst cell 140 with a reference gas room 150, is connected to the pump cell 120. The reference gas room 150 is provided with a reference electrode (RE) 155 in the direction of the pump cell 120. The voltage that is regulated between the reference electrode 155 and the Nernst electrode 145 in the measuring room 130 of the pump cell 120 corresponds with the Nernst voltage. Furthermore, the heater 160 is arranged on the ceramic's lower area.

An oxygen reference gas is held in the reference gas room 150 of the Nernst cell 140. A pump current, which flows over the pump electrodes 125 and 135, sets an oxygen concentration in the measuring room, which corresponds with a lambda=1 concentration in the measuring room 130.

The controlling of the currents and the analysis of the Nernst voltage is undertaken by an activation or the control unit 200. An operation booster 220 measures a Nernst voltage that is applied at the reference electrode 155 and compares this voltage with a reference voltage U_Ref, which lies typically at about 450 mV. During abnormalities, the operation booster 220 impinges the pump cell 120 with a resistance 210 and the pump electrodes 125, 135 with a pump current.

Figure 2:
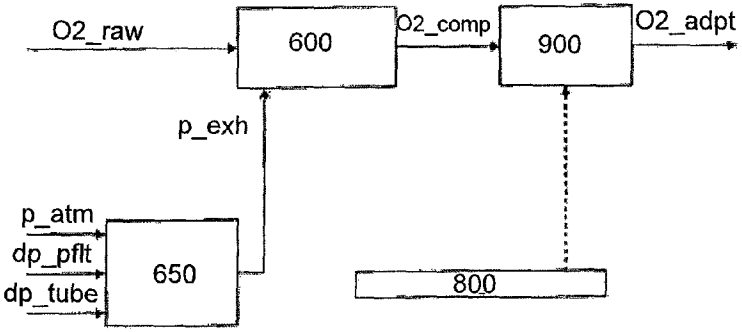
FIG. 2 PRIOR ART
FIG. 2 shows a determination of the gas concentration that is known from the state of the art.

FIG. 2 schematically shows a principally known procedure to determine an oxygen concentration in the exhaust gas as a gas concentration signal from the pump current I_pump. For this purpose, the oxygen raw signal or the gas concentration signal $O_2$_raw is conducted to a compensation module 600. The exhaust gas pressure p_exh that is applied to the gas sensor is calculated by an exhaust gas calculating module 650 from the surrounding pressure p_atm, a difference pressure of the particle filter dp_pflt and the known conduction pressure loss dp_tube. Based on the exhaust gas pressure p_exh and the gas concentration signal $O_2$_raw the compensation module 600 calculates a compensated gas concentration $O_2$_comp, for example according to formula 2, which results from rearranging formula 1.

$$\frac{k + \text{p_exh}}{\text{p_exh}} \frac{\text{p_0}}{k + \text{p_0}} \text{O2_raw(p_exh)} = \text{O2_raw(p_0)} = \text{O2_comp} \qquad \text{formula 2}$$

The compensation parameter is thereby constantly deposited in the compensation module 600 at the application of the gas sensor 100 and stays constant for the entire use of the gas sensor.

Since the pump current of a wide-band lambda probe that occurs in the air is only a specified example, it is usually provided to operate an adaption module 900 after the compensation module. This compensation module also causes a partial compensation of the pressure dependency of the concentration determination. Usually an adaption factor m_adpt is operated in the following adaption module 900 in such a way that an adapted gas concentration $O_2$_adpt=m_adpt*$O_2$_comp equals the gas concentration of the known measuring gas.

The gas concentration of the measuring gas or exhaust gas is typically known at an overrun condition operation of the combustion engine. The overrun condition operation is detected by a detection 800 and signalized to the adaption module 900. During the overrun condition, operation the combustion engine is typically not supplied with fuel. Therefore the sucked-in fresh air gets into the exhaust gas system without a combustion and surrounds the gas sensor. The adaption module 900 tracks the adaption factor in the overrun condition operation of the combustion engine in such a way that the adapted oxygen concentration $O_2$_adpt corresponds with the known oxygen concentration of fresh air of 20.95%. The adaption factor m_adpt that has been determined and set during the overrun condition operation is afterwards used for the remaining operating modes of the combustion engine.

Figure 3:
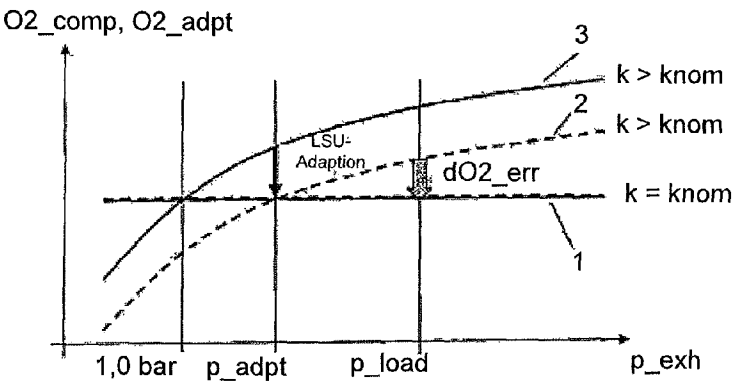
FIG. 3 shows a determination of the gas concentration according to the invention.

FIG. 3 schematically shows the adaption of the compensated gas concentration $O_2$_comp. The pressure in the measuring gas is on the x-coordinate and the gas concentration on the y-coordinate. If the applied or nominal compensation parameter $k_{nom}$ is still present, the gas concentration signal $O_2$_raw is sufficiently compensated by the compensation module 600, so that the gas concentration stays constant over all pressure values for $k=k_{nom}$ according to graph 1 in FIG. 3.

If the compensation parameter k of the gas sensor deviates from the nominal value, the determined compensated gas concentration $O_2$_comp changes over the pressure in a non-linear way despite the constant gas concentration corresponding with graph 3. In order to balance the signal deviations it is provided, as already described above, the compensated gas concentration $O_2$_comp is adapted onto the actual gas concentration in the overrun condition operation at the present adaption pressure p_adpt. This is shown schematically in FIG. 3, whereby graph 3 is moved by an adaption amount and then results in the adapted gas concentration $O_2$_adpt according to graph 2.

As it can be seen in FIG. 3, such a compensation basically only works for the adaption pressure p_adpt. Other pressures p_load result in a more or less significant error d$O_2$_err. According to the tolerance situation of the compensation parameter k of the present gas sensor, an adequate over-compensation or under compensation takes place by the adaption, because the pressure compensation is only possible for nominal compensation parameters k according to the adaption module 900.

This remaining error d $O_2$_err is especially disturbing for vehicles with particle filters, since the range of the exhaust gas pressure is big and can for example alternate between 0.8 bar at a regenerated particle filter and up to 2 bar or more at a loaded particle filter.

For a precise concentration measurement it is now provided according to the invention, that the compensation parameter k is not only applied when installing the gas sensor but that it is also adapted during operation. This has the advantage that in the case of deviations from the nominal compensation parameter these deviations can be compensated or adapted already in the compensation module 600.

Figure 4:
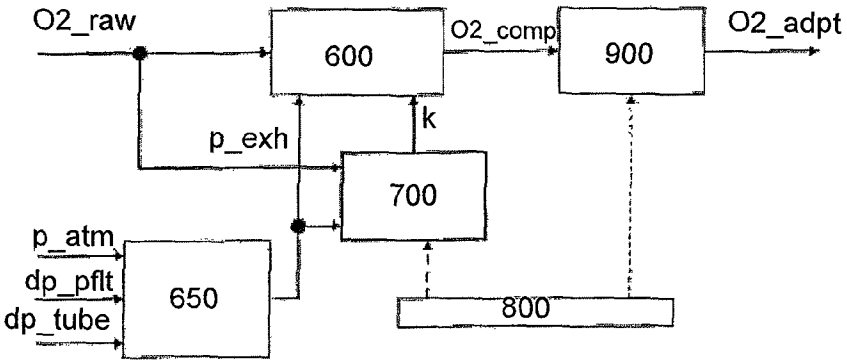
FIG. 4 is a block diagram, according to an example embodiment of the present invention.

Using the same reference signs from above, FIG. 4 shows the elements that are already known from FIG. 2. In addition to the embodiment that is known from FIG. 2, a compensation parameter adaption module 700 is provided, which undertakes an adaption of the compensation parameter k and provides it to the compensation module 600 in the presence of an overrun condition operation, signalized by the detection 800, based on the gas concentration signal $O_2$_raw and the exhaust gas pressure p_exh.

The gas concentration signal or oxygen raw value $O_2$_raw of the gas sensor and the calculated exhaust gas pressure p_exh are recorded during the overrun condition operation. Because the physical oxygen concentration is constantly 20.95% during the overrun condition operation, the variation of the oxygen raw value $O_2$_raw is only caused by the parasitic pressure influence.

Figure 5:
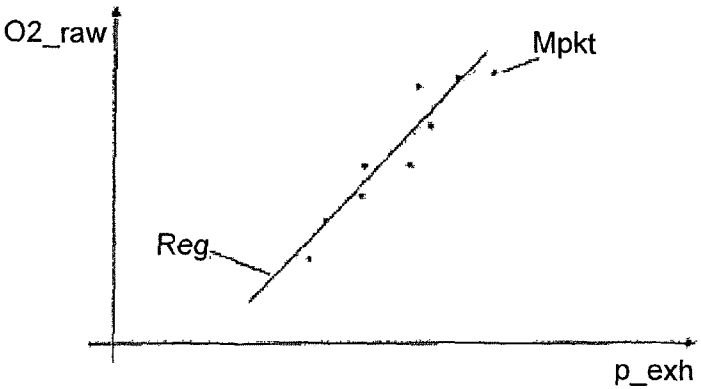
FIG. 5 is a diagram, according to an example embodiment of the present invention.

A first embodiment of the suggested procedure is shown as an example in FIG. 5. The exhaust gas pressure p_exh and the associated oxygen raw value $O_2$_raw are determined at different moments during the overrun condition operation. Using known statistic procedures a regression straight line is calculated by the determined points $O_2$_raw(p_exh). The measuring points $O_2$_raw(p_exh) can be measured for example during one or more overrun condition operations of the combustion engine. A large amount of measuring points is advantageous in order to get a high correlation quality. The increase m of the regression straight line is a measure for the pressure sensibility of the obstructed probe exemplar and thus allows a measurement of the actual pressure dependency.

A sufficiently wide value range for the starting values is given in order to achieve a sufficient correlation quality, because the exhaust gas varies during the overrun condition operation naturally. The engine speed sinks during the overrun condition operation, whereby this also results in a sinking of the exhaust gas volume current and the exhaust gas pressure. Thus a variety of measuring points is given by means of which a sufficiently accurate regression line can be calculated. The generic compensation parameter can then be calculated for example with the following formula 3 from the increase m of the gas concentration function according to formula 1 or formula 2.

$$m = \frac{k \cdot (k + \text{p_0})}{\text{p_0} \cdot (k + \text{p_x})} \Rightarrow \text{_k} = \frac{\text{p_0}}{2 \cdot (m \cdot \text{p_0} - 1)}\left(1\text{-}2 \cdot m \cdot \text{p_x} \pm \sqrt{1\text{-}4 \cdot m \cdot \text{p_x} \cdot \left(\frac{1 - \text{p_x}}{\text{p_0}}\right)}\right)$$

Formula 3 above results from the derivative of formula 1 according to the pressure p_exh and the linearization for the working point p=p_x=average exhaust gas pressure during the overrun condition operation.

It is provided in a further embodiment to waive the calculation of a regression line through the measuring points $O_2$_raw(p_exh) and instead calculate an assigned compensation parameter for each measuring point according to the following formula 4:

$$k = \frac{\text{p_0} \cdot \text{p_exh} \cdot (1 - \text{O2_raw(p_exh)} / \text{O2_raw(p_0)})}{\text{p_0} \cdot \text{O2_raw(p_exh)} / \text{O2_raw(p_0)} - \text{p_exh}} \qquad \text{Formula 4}$$

Formula 4 results from a mathematic transformation of formula 1. The oxygen concentration $O_2$_raw also has to be determined for a random reference pressure p__0 during the overrun condition operation in this modification. In order to suppress unavoidable disturbing influences onto the signal $O_2$_raw the compensation parameter k should be evened out according to formula 4 preferably by a low pass filter. In the first embodiment the disturbance suppression is already provided by the regression line.

The compensation parameter that has been identified with the aid of the previously mentioned method is also used outside of the overrun condition operational mode for the pressure compensation of the oxygen raw signal or gas concentration signal $O_2$_raw and replaces the applied nominal compensation parameter $k_{nom}$. Thus the accuracy of the released compensated oxygen signal $O_2$_comp is improved especially for high exhaust gas pressures as they occur under full load of the combustion engine and/or at a loaded particle filter.

The invention claimed is:

1. A method of determining a gas concentration in a measuring gas with a gas sensor, the method executed by a control unit of a combustion engine, the method comprising:

detecting a gas concentration parameter value with the gas sensor and an exhaust gas pressure parameter value in a first operation mode of the combustion engine in which the gas concentration in the measuring gas is known;

determining a pressure dependent function of the gas concentration based on the detected gas concentration parameter value and the exhaust gas pressure parameter value; and calculating a compensation parameter based on the detected gas concentration parameter value and an average value of the exhaust gas pressure parameter value during the first operation mode of the combustion engine, the compensation parameter being a k-value determined based on the pressure dependent function;

wherein the compensation parameter is taken into account afterwards in at least a second operation mode of the combustion engine for the determination of the gas concentration.

2. A method according to claim 1, further comprising calculating the compensation parameter in at least one overrun condition operation of the combustion engine.

3. A method according to claim 2, further comprising determining the gas concentration parameter value and the exhaust gas pressure parameter value at different moments during the at least one overrun condition operation.

4. A method according to claim 1, further comprising calculating the compensation parameter from the detected gas concentration parameter value and the exhaust gas pressure parameter value with the aid of a statistical procedure.

5. A device configured to determine a compensation parameter of a gas sensor, comprising:

a compensation module configured to determine a compensated gas concentration and an exhaust gas pressure;

an overrun detection configured to determine an overrun condition operation of the combustion engine;

an adaption module configured to adapt a compensated gas concentration; and a compensation parameter adaption module;

wherein the compensation parameter adaption module, in the presence of an overrun condition operation of the combustion engine based on the detected gas concentration parameter value and an average value of the exhaust gas pressure during the overrun condition operation, calculates a compensation parameter of the gas sensor, wherein a pressure dependent function of gas concentration is determined based on the detected gas concentration parameter value and the exhaust gas pressure, the compensation parameter being a k-value determined based on the pressure dependent function.

* * * * *